US008177937B2

(12) United States Patent
Nordgaard et al.

(10) Patent No.: US 8,177,937 B2
(45) Date of Patent: May 15, 2012

(54) METHOD AND AN APPARATUS FOR CONTROLLING A FLOW OF PULP SUSPENSION

(75) Inventors: Dennis Nordgaard, Sundsvall (SE); Johan Stenmark, Sundsvall (SE); Peter Danielsson, Piteå (SE)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 12/999,189

(22) PCT Filed: Jul. 1, 2009

(86) PCT No.: PCT/SE2009/050846

§ 371 (c)(1),
(2), (4) Date: Dec. 15, 2010

(87) PCT Pub. No.: WO2010/002348

PCT Pub. Date: Jan. 7, 2010

(65) Prior Publication Data

US 2011/0139384 A1 Jun. 16, 2011

(30) Foreign Application Priority Data

Jul. 3, 2008 (SE) ..... 0801588

(51) Int. Cl.
*D21C 7/12* (2006.01)

(52) U.S. Cl. ..... 162/61; 162/232; 162/233; 162/252

(58) Field of Classification Search ..... 162/61, 162/232, 233, 252
See application file for complete search history.

(56) References Cited

U.S. PATENT DOCUMENTS

| | | | |
|---|---|---|---|
| 3,096,234 | A | 7/1963 | Armstrong et al. |
| 4,378,978 | A | 4/1983 | Andersson et al. |
| 5,800,674 | A | 9/1998 | Iivonen et al. |
| 5,851,350 | A | 12/1998 | Timperi |
| 6,186,333 | B1 | 2/2001 | Hautala et al. |
| 2007/0066792 | A1 | 3/2007 | Colhoun et al. |

FOREIGN PATENT DOCUMENTS

| | | |
|---|---|---|
| EP | 0280234 A2 | 8/1988 |
| EP | 0420791 A2 | 4/1991 |
| SE | 516352 C2 | 12/2001 |

OTHER PUBLICATIONS

International Search Report and Written Opinion, PCT/SE2009/050846, dated Oct. 7, 2009.

*Primary Examiner* — Mark Halpern
(74) *Attorney, Agent, or Firm* — Lerner, David, Littenberg, Krumholz & Mentlik, LLP

(57) ABSTRACT

Apparatus and methods for controlling the flow of a pulp suspension from a container in which the pulp is processed or stored are disclosed. The container is pressurized to a first pressure and includes an outlet for the pulp suspension, a pump includes an inlet and an outlet, and the pump inlet is connected to the container. The pulp suspension is fed from the inlet to the outlet of the pump and provides a controlled decrease in pressure to which the pulp suspension is subjected in the pump during such transport, and the flow from the container is controlled by adjusting this controlled decrease in pressure.

13 Claims, 2 Drawing Sheets

METHOD AND AN APPARATUS FOR CONTROLLING A FLOW OF PULP SUSPENSION

CROSS-REFERENCE TO RELATED APPLICATIONS

The present application is a national phase entry under 35 U.S.C. §371 of International Application No. PCT/SE2009/050846 filed Jul. 1, 2009, published in English, which claims priority from Swedish application No. 0801588-5, filed Jul. 3, 2008, all of which are incorporated herein by reference.

FIELD OF THE INVENTION

The present invention relates to a method for controlling a flow of pulp suspension from a container where the pulp suspension is processed and/or stored, which container is pressurized to a predetermined pressure and is provided with at least one outlet for the outflow of the pulp suspension. More particularly, the present invention relates to an apparatus for controlling a flow of pulp suspension, which apparatus comprises a container for processing and/or storing the pulp suspension, which container is adapted to be pressurized to a predetermined pressure and is provided with at least one outlet for the outflow of pulp suspension.

BACKGROUND OF THE INVENTION

In processes for manufacturing paper and in processes where cellulose-containing fiber pulp is processed for other purposes there are different steps where the pulp suspension, which comprises cellulose-containing material, such as fibers, mixed with a liquid, such as a liquor, is processed under pressure in different kinds of pressurized containers. An example of such a step is the cooking of pulp, where wood chips are fed into a pressure-tight container of a pulp digester and are processed or treated at a certain temperature and under a certain pressure. European Patent No. 420,791 discloses a process and a mechanism for cooking pulp and discharging pulp digesters. Another example of a step in which pulp suspensions are processed under pressure is screening, where the pulp suspension is fed into a pressure-tight container, and under pressure is screened to separate the reject, comprising material with too large dimensions, from the accept, which is transported further in the process for subsequent processing steps in the process. U.S. Pat. No. 6,186,333 discloses a method and an apparatus for screening pulp suspensions.

When cooking in pressurized containers, as mentioned above, valves are used at the outlet of the container, which valves are closed during the process or treatment to maintain the pressure in the container and thereafter are opened when discharging pulp suspension from the container. In the screening disclosed in U.S. Pat. No. 6,186,333, there are valves in the outlet channels for both the reject and the accept. However, there are problems when using valves at the outlets of pressurized containers.

When valves are used in pressurized screening devices for outlets with small pulp flows, the cross-section of the passage where the valve is provided must be small in order to maintain a sufficiently high pressure in the container. This is, for example, the case for the reject outlet of pressurized screening devices where the reject flow often is small. The reduced cross-section area in these passages produce a flow resistance, and the result is that clogging easily occurs, which results in operational disturbances. A solution to this problem is to add additional dilution fluid prior to the valve. However, this is not desirable as it negatively affects the liquid balance. In European Patent No. 280,234, a solution to the problem of flow resistance in a valve used in a line for processing and controlling pulp suspensions of a high pulp consistency is disclosed. Here, the pulp suspension is fluidized just prior to the valve by a rotating rotor which is provided inside the valve body. The purpose of this rotating rotor is also to efficiently mix added chemicals with the pulp suspension, which is effected by adding chemicals in connection with the rotor's fluidization of the pulp suspension.

Problems also arise when valves are used in connection with pulp digesters at the outlet for discharging the pressurized container of the pulp digester. When the valve in the outlet of the container is opened after the cooking is finished, the pulp suspension is blown out of the container in an uncontrolled manner by the pressure produced in the container, which produces unwanted channeling of the pulp suspension in the container, which, inter alia, results in pulp remaining along the inner walls of the container and getting stuck. This pulp must then be removed, e.g. by pressurized washing, prior to the next cooking, which results in stops in the production. European Patent No. 420,791 discloses a solution to this problem and additional problems resulting from such blow-out of pulp suspensions, where the valve in the outlet of the container is cyclically opened and closed during the discharge, which is suggested to prevent the channeling in the pulp suspension.

However, the solutions of European Patent No. 420,791 and European Patent No. 280,234 do not provide a sufficiently efficient or controlled flow of pulp suspension from a pressurized container.

One object of the present invention is thus to provide a more efficient control of a flow of pulp suspension from a pressurized container in relation to prior art.

SUMMARY OF THE INVENTION

In accordance with the present invention, this and other objects have now been realized by the discovery of a method for controlling a flow of pulp suspension from a container maintained at a first pressure and including an outlet for the pulp suspension, the method including pumping the flow of the pulp suspension from the outlet of the container through a pump, the pump including an inlet and an outlet, subjecting the flow of the pulp suspension to a predetermined pressure decrease from the inlet of the pump to the outlet of the pump, and adjusting the flow of the pulp suspension from the container by controlling the predetermined pressure decrease created by the pump. Preferably, the method includes increasing the flow of the pulp suspension from the container by decreasing the predetermined pressure decrease with respect to the first pressure and decreasing the flow of the pulp suspension from the container by increasing the predetermined pressure decrease with respect to the first pressure.

In accordance with one embodiment of the method of the present invention, the method includes measuring the flow of the pulp suspension from the container and adjusting the predetermined pressure decrease created by the pump based on the measured flow of the pulp suspension from the container. In accordance with another embodiment of the method of the present invention, the pump comprises a centrifugal pump, and the method includes controlling the predetermined pressure decrease by adjusting the centrifugal pump.

In accordance with another embodiment of the method of the present invention, the container includes a screening device, the outlet from the container comprising a reject outlet, and the container further including an accept outlet, the pump being connected to the reject outlet, and the method including controlling the flow of the pulp suspension from the reject outlet by adjusting the predetermined pressure decrease.

In accordance with another embodiment of the method of the present invention, the container comprises a pulp digester, and the method includes controlling the flow of the pulp suspension from the pulp digester by adjusting the predetermined pressure decrease.

In accordance with the present invention, this and other objects have also been realized by the discovery of apparatus for controlling a flow of pulp suspension comprising a container for processing or storing the pulp suspension, the container adapted to maintain a first pressure and including at least one outlet for the pulp suspension, a pump including an inlet for receiving the pulp suspension from the at least one outlet of the container and an outlet for the flow of the pulp suspension, whereby the flow of the pulp suspension is subjected to a predetermined pressure decrease from the inlet to the outlet of the pump, and a controller for adjusting the predetermined pressure decrease within the pump, whereby the flow of the pulp suspension from the container is controlled thereby. Preferably, the controller is adapted to decrease the predetermined pressure decrease with respect to the first pressure in order to increase the flow of the pulp suspension from the container and to increase the predetermined pressure decrease with respect to the first pressure in order to decrease the flow of the pulp suspension from the container.

In accordance with one embodiment of the apparatus of the present invention, the apparatus includes at least one measurement device for measuring the flow of the pulp suspension from the container, the measurement device being connected to the controller, whereby the controller can adjust the predetermined pressure decrease within the pump based on the measured value from the measurement device.

In accordance with another embodiment of the apparatus of the present invention, the pump comprises a centrifugal pump whereby the predetermined pressure decrease can be adjusted by adjusting the centrifugal pump.

In accordance with another embodiment of the apparatus of the present invention, the container includes a screen for screening the pulp suspension. Preferably, the outlet from the container comprises a reject outlet, and the container further includes an accept outlet, the pump being connected to the reject outlet.

In accordance with another embodiment of the apparatus of the present invention, the container comprises a pulp digester, the pump being connected to the outlet of the pulp digester whereby the flow of the pulp suspension can be controlled thereby.

In accordance with the present invention, an efficient control of a flow of pulp suspension from a pressurized container in relation to prior art is achieved.

The controlled decrease in pressure which the pulp suspension is subjected to in the pump device is something that the pressure originating from the container must overcome in order to transport the pulp suspension in the direction away from the container. This means that the pressure on the pulp suspension, which originates from the container, must be higher than the decrease in pressure which the pulp suspension is subjected to in the pump device. The controlled decrease in pressure can be illustrated as a "counter pressure" in the direction towards the container, which is built up on the inlet side of the pump device.

By means of the pump device, a counter pressure is attained, and at the same time, a passage with a large cross-sectional area can be provided in the outlet channel from the outlet of the container, since there is no need for a small cross-sectional area in the pump device in order to produce a sufficient counter pressure. The pump device is an efficient substitute for the valve which is conventionally situated after the outlet of the container, which valve provides a decrease in pressure or a "counter pressure" to control the flow. By means of the present invention, clogging of the outlet upon pressurized screening and channeling in the pulp suspension when discharging pulp digesters are prevented. The flow is here defined as the volume of pulp suspension per unit of time ($m^3/s$).

The conventional use of a pump device is that the pulp suspension is fed in at the suction side and is fed out on the pressure side. In accordance with the present invention, the pump device is instead used in a "reversed" manner. The pump device aims to "force" the pulp suspension in the direction towards the container and produces a counter pressure in the direction towards the container, but since the pressure in the container is allowed to be higher than this counter pressure, the pressure in the container forces, or moves, the pulp suspension into the pressure side of the pump device, through the pump housing of the pump device and out on the suction side for subsequent transport. By this, the flow from the container can be adjusted by means of the pump device. When the counter pressure produced by the pump device is equal to the pressure in the container, there is a balance, or break point, at which the pulp suspension from the container is still. Advantageously, the pump device comprises an open impeller where the blades, for example, form a vortex shape. In this manner, a large free passage for the flow through the pump, and good pump efficiency, are provided.

In the conduit or pipe system from the container, pipe losses can be present which result in small decreases in pressure of the pulp suspension. Also, these small decreases in pressure are something that the pressure in the container must overcome in order to move the pulp suspension in the direction away from the container.

According to an advantageous embodiment of the method according to the present invention, the flow from the container is increased by decreasing the controlled decrease in pressure in relation to the pressure in the container, and the flow from the container is decreased by increasing the controlled decrease in pressure in relation to the pressure in the container. In this manner, an easily controlled and efficient control of the flow is attained. Adjustment of the controlled decrease in pressure is efficiently achieved by decreasing and increasing, respectively, the rotational speed of the pump.

According to a further advantageous embodiment of the method according to the present invention, measuring of the flow of pulp suspension from the container is performed, and adjustment of the controlled decrease in pressure is based on this measuring. Advantageously, the measuring is effected by a flow meter situated in connection with the flow. In this manner, automatic control of the flow is provided, which results in an even more efficient control of the flow from the pressurized container.

According to another advantageous embodiment of the method according to the present invention, the pump device is provided with a centrifugal pump, and the controlled decrease in pressure is provided and adjusted by the centrifugal pump. By means of the centrifugal pump, an efficient and easily managed control of the flow is attained because this pump has a large free passage for the flow in the pump housing, and at the same time it provides for good pump efficiency.

According to yet another advantageous embodiment of the method according to the present invention, the container is included in a screening device for screening a pulp suspension, the container of the screening device comprising a first outlet for reject and a second outlet for accept, where the pump device is connected to the first outlet of the container, and the reject flow is controlled by adjusting the controlled decrease in pressure.

By applying the solution of the present invention to the pressurized container of a screening device, and especially to the reject flow, which is often a small flow, efficient control of the outflow of pulp suspension is provided, where the risk of clogging in the outlet channels is minimized because the cross-sectional area of the channels does not need to be reduced to attain a sufficient counter pressure. The solution is especially advantageous with regard to the final pressurized screening, in a so-called final step screen, where the reject is discharged to atmospheric pressure, and where great differences in pressure are present. The pulp consistency of the reject flow is advantageously between 1 and 5%, more advantageously between about 1 and 3%, but other pulp consistencies are also possible.

According to a further advantageous embodiment of the method according to the present invention, the container is included in a pulp digester, and the container of the pulp digester is discharged under control by adjusting the controlled decrease in pressure.

By applying the solution of the present invention to the pressurized container of a pulp digester where there initially is a high pressure in the container, the container of the pulp digester can be discharged in a controlled manner, whereby negative channeling in the pulp suspension in the container is avoided, and the inner walls of the container do not need to be washed by means of pressurized washing in order to remove the remaining pulp. The pulp consistency of the pulp suspension to be discharged from the pressurized digester is advantageously between about 5 and 10%, more advantageously between about 7 and 8%, but also other pulp consistencies are also possible.

The present invention can also be applied to other apparatus or other steps where control of the outflow from a pressurized container is required.

According to an advantageous embodiment of the apparatus according to the present invention, the control device is adapted to decrease the controlled decrease in pressure in relation to the pressure in the container in order to increase the flow from the container, and the control device is adapted to increase the controlled decrease in pressure in relation to the pressure in the container in order to decrease the flow from the container.

According to a further advantageous embodiment of the apparatus according to the present invention, the apparatus comprises at least one measuring means for measuring the flow of pulp suspension from the container, which measuring means is connected to the control device, and the control device is adapted to control the pump device based on the measurement values of the measuring means. The measuring means is advantageously a flow meter provided in connection with the flow.

According to another advantageous embodiment of the apparatus according to the present invention, the pump device comprises a centrifugal pump adapted to provide and adjust the controlled decrease in pressure. However, it is possible to use other pumps which provide a controlled decrease in pressure and present a suitable internal free passage for the pulp suspension.

According to still another advantageous embodiment of the apparatus according to the present invention, the container is included in a screening device for screening a pulp suspension.

According to another advantageous embodiment of the apparatus according to the present invention, the container of the screening device comprises a first outlet for reject and a second outlet for accept, and the pump device is connected to the first outlet of the container for controlling the flow of reject.

According to a further advantageous embodiment of the apparatus according to the present invention, the container is included in a pulp digester, and the pump device is connected to the container of the pulp digester for controlling the flow therefrom. In this manner, controlled discharge of the container of the pulp digester is attained.

Further advantageous embodiments of the method and the apparatus according to the present invention and further advantages and aspects of the present invention emerge from the detailed description of embodiments.

BRIEF DESCRIPTION OF THE DRAWINGS

The present invention will now be described, for exemplary purposes, in more detail by way of embodiments and with reference to the enclosed drawings, in which.

DETAILED DESCRIPTION

Figure 1:
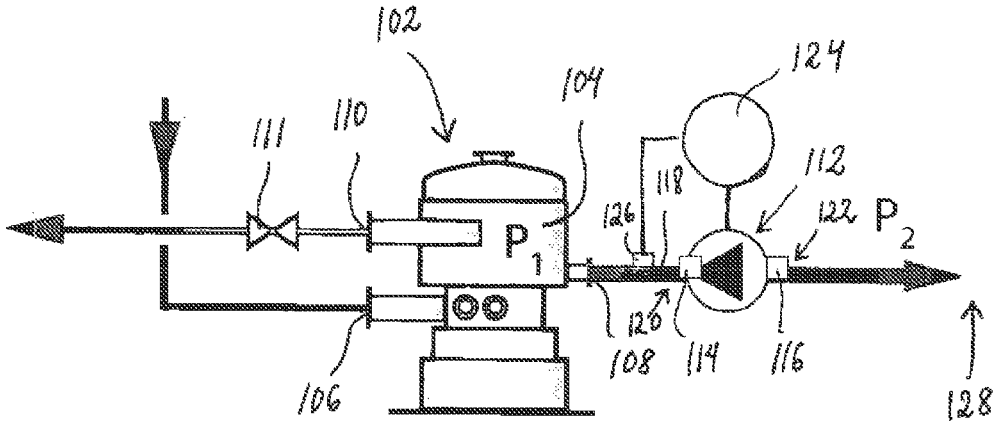
FIG. 1 is a side, elevational, partially schematic view of a first embodiment of the apparatus according to the present invention, in which the container is included in a pressurized screening device.

FIG. 1 schematically shows an embodiment of the apparatus for controlling a flow of cellulose-containing pulp suspension according to the present invention, where the apparatus comprises a pressure-tight container 104 included in a screening device 102 for screening a cellulose-containing pulp suspension. The container 104 is adapted to be pressurized and is provided with an inlet 106 for the inflow of pulp suspension, a first outlet 108 for the reject and a second outlet 110 for the accept. The outflow of the accept from the second outlet 110 is controlled by a valve 111. In the container 104 a screen basket is provided, inside of which the pulp suspension fed from the inlet 106 is received. The accept passes the screen basket and is transported out by means of the second outlet 110. The reject does not pass the screen basket, because of its too large dimensions, and is transported downwards and is fed out by means of the first outlet 108. The container 104 is adapted to the pressurized to a pressure $p_1$, which pressure $p_1$ can be any suitable pressure.

The apparatus includes a pump device 112, in the form of a centrifugal pump, which comprises an impeller provided in a pump housing. The pump device 112 has an inlet 114 for feeding in the pulp suspension and an outlet 116 for feeding out the pulp suspension for subsequent transport. The inlet 114 of the pump device 112 is connected to the first outlet 108 of the container 104 by means of a conduit 118. The pump device 112 is adapted to provide a controlled decrease in pressure $\Delta p$ which the pulp suspension is subjected to in the pump device 112 during its transport form the inlet 114 to the outlet 116 of the pump device 112. The pump device 112 has a pressure side 120 and a suction side 122, where the pressure side 120 comprises the inlet 114 of the pump device 112, and the suction side 122 comprises the outlet 116 of the pump device 112.

In this manner, the flow is defined as the volume of pulp suspension per unit of time ($m^3/s$), and the flow rate is the rate of the flow and is given in meters per second (m/s).

A control device 124, in the form of a computer unit, is adapted to control the pump device 112 to adjust the controlled decrease in pressure Δp, which adjustment controls the flow from the container 104. The control device 124 is adapted to decrease the controlled decrease in pressure Δp in relation to the pressure $p_1$ in the container 104 in order to increase the flow from the container 104, and the control device 124 is adapted to increase the controlled decrease in pressure Δp in relation to the pressure $p_1$ in the container 104 in order to decrease the flow from the container 104. The control device 124 is connected to a flow meter 126 for measuring the flow of pulp suspension from the container 104, and the control device 124 is adapted to control the pump device 112 based on the measurement values of the flow meter 126.

If the measurement values of the flow meter 126 show that the reject flow from the container 104 should be increased, the control device 124 is adapted to control the pump device 112 to decrease the rotational speed, whereby the rotational speed of the impeller of the pump device 112 is decreased, which provides a decrease of the controlled decrease in pressure Δp in relation to the pressure $p_1$ in the container 104, which in turn results in an increase of the reject flow. If the measurement values of the flow meter 126 show that the reject flow from the container 104 should be decreased, the control device 124 is adapted to control the pump device 112 to increase the rotational speed, whereby the rotational speed of the impeller of the pump device 112 is increased, which provides an increase of the controlled decrease in pressure Δp in relation to the pressure $p_1$ in the container 104, which in turn results in a decrease of the reject flow. During this control, a sufficiently high pressure in the container 104 is maintained.

The flow control can be explained according to the following: The flow from the container 104 to a subsequent step 128, such as a subsequent process step, where the pressure is $p_2$, is dependent on the pressure $p_1$ in the container 104, which pushes the pulp suspension in the direction away from the container 104, on the pressure $p_2$ in the subsequent step 128, which pushes the pulp suspension in the direction towards the container 104, on pressure losses in the conduits $\Delta p_{losses}$, which results in a decrease in pressure which the pressure $p_1$ in the container 104 must overcome in order to continue to move the pulp in the direction away from the container 104, on the controlled decrease in pressure Δp provided by the pump device 112 and possibly on other isolated decreases in pressure. The subsequent step 128 can be any step where the reject is received after it has left the screening device 102, and the pressure $p_2$ in this step usually corresponds to the atmospheric pressure. Thus, the pressure balance can have the following expression:

$$p_1-\Delta p_{losses}-\Delta p-p_2=0 \quad [1]$$

The controlled decrease in pressure Δp which is produced by the pump device 112 is dependent on the rotational speed n of the pump device 112, and can be expressed as Δp(n). $\Delta p_{losses}$ is dependent on the flow and can be defined as:

$$\Delta p_{losses} = \xi\frac{\rho}{2}v^2,$$

Where ξ is the viscous resistance value of the conduits which guide the flow, ρ is the density of the flow, and ν is the flow rate (m/s) and is equal to the flow Q (m3/s) divided by the cross-sectional area A ($m^2$) of the conduit. If the expression for $\Delta p_{losses}$ and ν is incorporated into equation [1], the following is obtained:

$$p_1 - \xi\frac{\rho}{2}\frac{Q^2}{A^2} - \Delta p(n) - p_2 = 0 \quad [2]$$

From the equation [2], the following expression for the flow Q(n) as a function of the rotational speed n of the pump device 112 is obtained:

$$Q(n) = k\sqrt{p_1 - \Delta p(n) - p_2}, \quad [3]$$

$$\text{where } k = \sqrt{\frac{2A^2}{\xi\rho}}$$

For a certain installation and flow density, k is a constant. In order to provide a flow which is not in the direction towards the container 104, the case must be the following: $p_1 \geqq \Delta p(n)+p_2$. If $p_1=\Delta p(n)+p_2$ there is pressure balance and there is no flow of pulp suspension from the first outlet 108 of the container. If $p_2$ corresponds to atmospheric pressure, the pressure $p_1$ is considerably higher than $p_2$, and the influence of the pressure $p_2$ on the flow Q(n) can be neglected. Thus, generally, the pressure $p_1$ and the controlled decrease in pressure Δp determines the flow Q(n). When the decrease in pressure Δp provided by pump device 112 is increased by increasing the rotational speed of the pump device 112, the flow Q(n) decreases, and when the decrease in pressure Δp provided by pump device 112 is decreased by decreasing the rotational speed of the pump device 112, the flow Q(n) increases. At the outlet 116 of the pump device 112, after the controlled decrease in pressure Δp, the pressure is equal to $p_1$ minus Δp. If the pressure shall continue to move the pulp in the conduit after the pump device 112 in the direction away from the container and towards the subsequent step 128, the active pressure $p_1-\Delta p$ at the outlet 116 must be sufficiently high, and especially higher that the pressure $p_2$ in the subsequent step 128. In this embodiment, where the container 104 is included in a screening device 102, the pressure $P_1$ in the container 104 is substantially constant during the entire control of the flow from the outlet 108 of the container 104, and the pressure $p_1$ is maintained primarily by the valve 111 for the accept flow, and to a certain degree also by the pump device 112.

Figure 2:
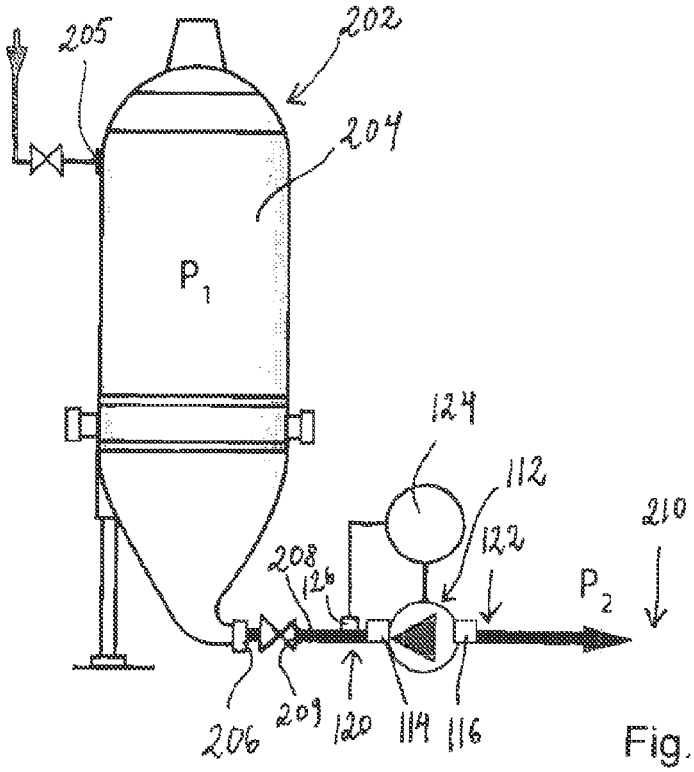
FIG. 2 is a side, elevational, partially schematic view of a second embodiment of the apparatus according to the present invention, in which the container is included in a pressurized pulp digester.

FIG. 2 shows an embodiment of the apparatus according to the present invention comprising a pressure-tight container 204 included in a pressurized pulp digester 202 for cooking cellulose-containing pulp suspension, which container 204 is adapted to be pressurized to a pressure $p_1$ and is provided with an inlet 205 for the inflow of wood chips, and an outlet 206 for discharging the pulp suspension after the cooking process. A pump device 112, as disclosed in connection with FIG. 1, is connected with its inlet 114 to the outlet 206 of the container 204 by means of a conduit 208. By said pump device 112, a control of the flow from the outlet 206 of the container 204 is effected, in a corresponding way as disclosed in connection with FIG. 1, and a controlled discharge of the container 204, without the above-mentioned negative channeling, is attained. Further, the apparatus comprises a flow meter 126 and a control device 124 as disclosed in connection with FIG. 1.

A valve 209 is provided between the outlet 206 of the container 204 and the pump device 112. The valve 209 is completely closed during the cooking in order to maintain the pressure in the container 204. Upon discharge of the container 204, this valve 209 is opened and the flow out of the container 204 is controlled by the pump device 112. During the control of a flow from the container 204 to a subsequent step 210, the controlled decrease in pressure $\Delta p(n)$ is controlled so that the pressure $p_1$ overcomes the decrease in pressure $\Delta p(n)$ and the pressure $p_2$ in the subsequent step 210, where the $p_2$ usually corresponds to the atmospheric pressure, whereby a flow of pulp suspension leaves the container 204 by means of the outlet 206. Alternatively, the valve 209 can be provided after the pump device 112 in the direction of the flow, i.e. between the pump device 112 and the subsequent step 210.

During the discharge of pulp suspension from the container 204 of the digester 202, the pressure $p_1$ in the container 204 decreases. If it is desirable to maintain a substantially constant flow from the container 204, the difference in pressure between $p_1$ and $\Delta p(n)$ must be kept constant, and in order to achieve this the controlled decrease in pressure $\Delta p(n)$ must be decreased during the discharge, and the decrease of the controlled decrease in pressure $\Delta p(n)$ shall correspond to the reduction of the pressure $p_1$.

Figure 3:
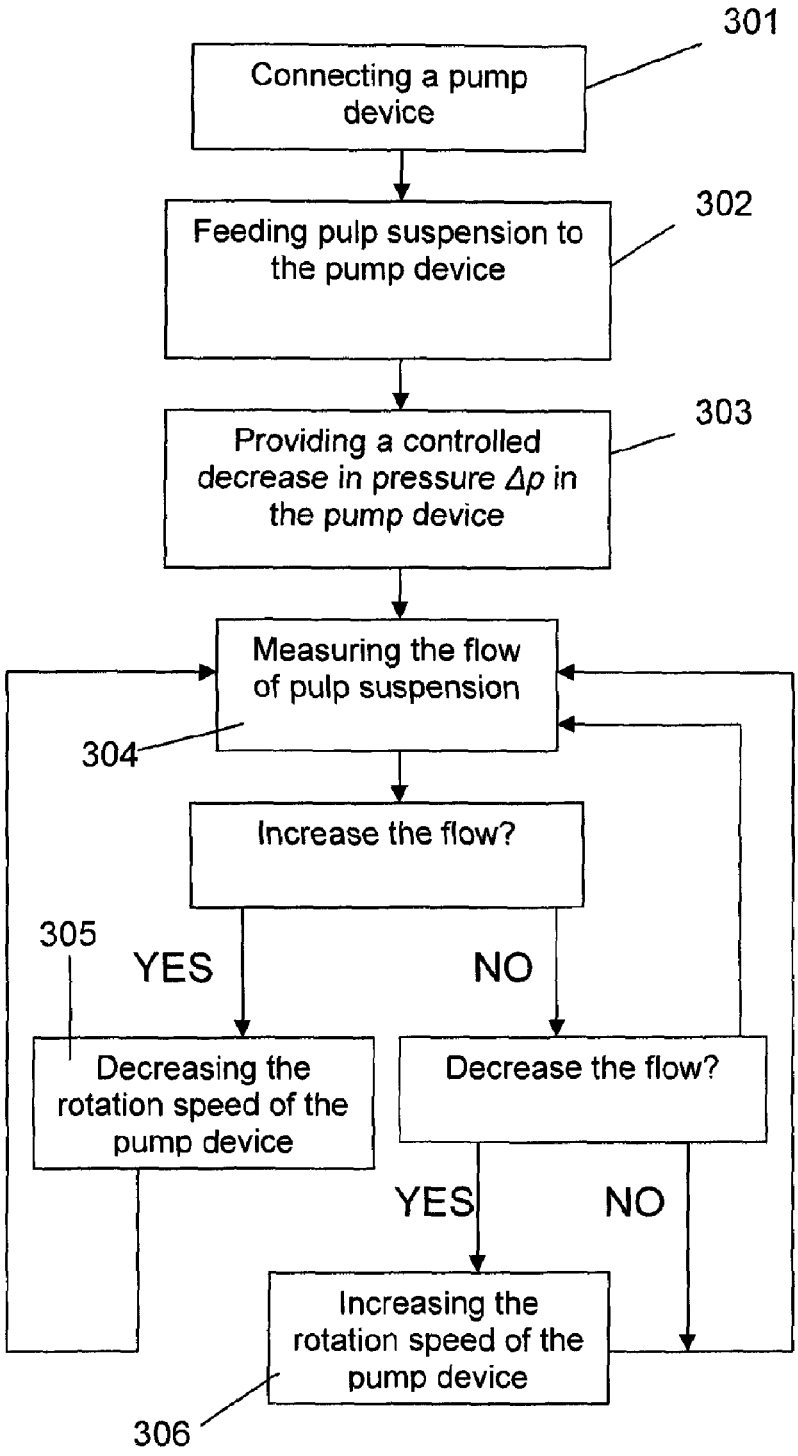
FIG. 3 is a flow chart illustrating aspects of the method according to the present invention.

FIG. 3 shows a flow chart which illustrates aspects of the method according to the present invention for controlling a flow of cellulose-containing pulp suspension from a pressurized container included in a pressurized screening device of a pulp digester, in which container a pressure $p_1$ is provided. The container is provided with an inlet for the inflow of pulp suspension or wood chips, and an outlet for the outflow of pulp suspension. The method comprises the following steps: a pump device provided with an inlet means and an outlet means, is connected by means of its inlet means to the outlet of the container, at 301. The pulp suspension is fed to the pump device by means of the inlet means and is fed out from the pump device by means of the outlet means, at 302. The pump device is forced to provide a controlled decrease in pressure $\Delta p$ which the pulp suspension is subjected to in the pump device during its transport from the inlet means to the outlet means, at 303. The flow of pulp suspension from the container is measured by means of a flow meter, at 304, which measurement can be effected by measuring the outflow of pulp suspension from the pump device, or the flow between the outlet of the container and the inlet means of the pump device.

If the measurement shows that the flow from the container shall be increased, the rotational speed of the pump device is decreased, i.e. the rotational speed of the impeller is reduced, at 305, whereby the controlled decrease in pressure $\Delta p$ is decreased in relation to the pressure $p_1$ in the container, which in turn results in an increase of the flow.

If the measurement shows that the flow from the container shall be decreased, the rotational speed of the pump device is increased, at 306, whereby the controlled decrease in pressure $\Delta p$ is increased in relation to the pressure $p_1$ in the container, which in turn results in a decrease of the flow.

In this manner, an efficient control of the flow of pulp suspension from the pressurized container is attained.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for controlling a flow of pulp suspension from a container maintained at a first pressure and including an outlet for said pulp suspension, said method including pumping said flow of said pulp suspension from said outlet of said container through a pump, said pump including an inlet and an outlet, subjecting said flow of said pulp suspension to a predetermined pressure decrease from said inlet of said pump to said outlet of said pump, and adjusting the flow of said pulp suspension from said container by controlling said predetermined pressure decrease created by said pump.

2. The method of claim 1 including increasing said flow of said pulp suspension from said container by decreasing said predetermined pressure decrease with respect to said first pressure and decreasing said flow of said pulp suspension from said container by increasing said predetermined pressure decrease with respect to said first pressure.

3. The method of claim 1 including measuring said flow of said pulp suspension from said container and adjusting said predetermined pressure decrease created by said pump based on said measured flow of said pulp suspension from said container.

4. The method of claim 1 wherein said pump comprises a centrifugal pump, and including controlling said predetermined pressure decrease by adjusting said centrifugal pump.

5. The method of claim 1 wherein said container includes a screening device, said outlet from said container comprising a reject outlet, and said container further including an accept outlet, said pump being connected to said reject outlet, and including controlling said flow of said pulp suspension from said reject outlet by adjusting said predetermined pressure decrease.

6. The method of claim 1 wherein said container comprises a pulp digester, and including controlling the flow of said pulp suspension from said pulp digester by adjusting said predetermined pressure decrease.

7. Apparatus for controlling a flow of pulp suspension comprising a container for processing or storing said pulp suspension, said container adapted to maintain a first pressure and including at least one outlet for said pulp suspension, a pump including an inlet for receiving said pulp suspension from said at least one outlet of said container and an outlet for said flow of said pulp suspension, whereby said flow of said pulp suspension is subjected to a predetermined pressure decrease from said inlet to said outlet of said pump, and a controller for adjusting said predetermined pressure decrease within said pump, whereby said flow of said pulp suspension from said container is controlled thereby.

8. The apparatus of claim 7 wherein said controller is adapted to decrease said predetermined pressure decrease with respect to said first pressure in order to increase said flow of said pulp suspension from said container and to increase said predetermined pressure decrease with respect to said first pressure in order to decrease said flow of said pulp suspension from said container.

9. The apparatus of claim 7 including at least one measurement device for measuring said flow of said pulp suspension from said container, said measurement device being connected to said controller, whereby said controller can adjust said predetermined pressure decrease within said pump based on the measured value from said measurement device.

10. The apparatus of claim 7 wherein said pump comprises a centrifugal pump whereby said predetermined pressure decrease can be adjusted by adjusting said centrifugal pump.

11. The apparatus of claim 7 wherein said container includes a screen for screening said pulp suspension.

12. The apparatus of claim 11 wherein said outlet from said container comprises a reject outlet, and wherein said container further includes an accept outlet, said pump being connected to said reject outlet.

13. The apparatus of claim 7 wherein said container comprises a pulp digester, said pump being connected to said outlet of said pulp digester whereby said flow of said pulp suspension can be controlled thereby.

* * * * *